US005593041A

United States Patent [19]

Capozzi

[11] Patent Number: 5,593,041

[45] Date of Patent: Jan. 14, 1997

[54] COMBINATION ARTICLE AND PACKAGE CONSTRUCTION

[75] Inventor: Lee Capozzi, Ridgefield, N.J.

[73] Assignee: Dan-Dee International Limited, Jersey City, N.J.

[21] Appl. No.: 488,587

[22] Filed: Jun. 8, 1995

[51] Int. Cl.[6] ..... B65D 73/00

[52] U.S. Cl. ..... 206/784; 206/462; 206/486; 206/526

[58] Field of Search ..... 206/461, 469, 206/465, 467, 483, 486, 487, 488, 489, 775, 779, 784, 526, 462

[56] References Cited

U.S. PATENT DOCUMENTS

| | | | |
|---|---|---|---|
| Re. 33,191 | 4/1990 | Matney . | |
| 2,788,189 | 4/1957 | Groya | 206/779 X |
| 2,949,185 | 8/1960 | Foote et al. | 206/486 X |
| 2,955,706 | 10/1960 | Emrich | 206/779 X |
| 2,990,056 | 6/1961 | Gillam | 206/763 X |
| 3,203,542 | 8/1965 | Lightner et al. | 206/462 X |
| 3,809,226 | 5/1974 | Ferrari . | |
| 4,166,533 | 9/1979 | Maitland . | |
| 4,240,552 | 12/1980 | Brown . | |
| 4,376,546 | 4/1982 | Acker | 206/461 X |
| 4,432,102 | 2/1984 | Woodruff et al. . | |
| 4,450,961 | 5/1984 | Bies et al. | 206/493 X |
| 4,549,654 | 10/1985 | Tiesman | 206/486 |
| 4,570,787 | 2/1986 | Forbes, Jr. | 206/486 X |
| 4,722,733 | 2/1988 | Howson . | |
| 4,805,766 | 2/1989 | Garcia | 206/461 X |
| 5,002,187 | 3/1991 | Rysner et al. | 206/461 |
| 5,129,516 | 7/1992 | Theros . | |

*Primary Examiner*—Bryon P. Gehman
*Attorney, Agent, or Firm*— Amster, Rothstein & Ebenstein

[57] ABSTRACT

A display package for holding and displaying a first article and a second article together in a complimentary fashion, the display package comprising of a back wall and base assembly, the back wall including a first provision for displaying and holding the first article in place with respect to the back wall, the base assembly having a second provision for displaying and holding the second article in place with respect to the base, the display package further including a support associated with the back wall for holding the second article and for supporting the back wall in a substantially vertical orientation relative to the base, the display package in a preferred embodiment being constructed from a piece of cardboard or like material, folded from a flat pattern along a plurality of predetermined fold lines.

8 Claims, 6 Drawing Sheets

COMBINATION ARTICLE AND PACKAGE CONSTRUCTION

BACKGROUND

1. Field of the Invention

This invention relates generally to a display package design and more particularly, to a package for captively holding and displaying a plurality of articles together in complimentary fashion.

2. Description of the Prior Art

Consumer product packages which capture and hold a product to be sold, yet which openly display the product and enable the consumer to touch, inspect and manipulate the same prior to purchase, are known in the art. However, most of the prior art display packages that are presently available are not configured to display a plurality of items, either related or unrelated to each other, concurrently in a complimentary fashion. Examples of such display packaging for a single product assembly include U.S. Pat. No. 3,809,226, which discloses a display package for a single cosmetic product that holds the product, yet permits a prospective purchaser to observe the product and, if necessary, to manipulate the product for evaluation. U.S. Pat. No. 5,129,516, teaches a clamshell blister package for holding and displaying a tape measure, where access can be had to the tape measure while it remains in the package. Another blister package is shown in U.S. Pat. No. Re. 33,191, for displaying a face powder product that is accessible to the purchaser for sampling while still protecting its contents.

Although packages adapted for displaying a plurality of items concurrently are known in the prior art, they are typically of sophisticated construction, utilizing a multiplicity of component parts, and are relatively expensive to produce. Examples are shown in U.S. Pat. No. 4,166,533, which teaches a package comprised of a plastic film having a plurality of internal walls and panels for displaying a plurality of syringes; and U.S. Pat. No. 4,722,733, which discloses a drug handling package for a plurality of drug delivery and storage receptacles.

SUMMARY OF THE INVENTION

In view of the foregoing, it is an object of the present invention to provide a display package which facilitates the display of a plurality of articles together in a complimentary fashion.

It is another object of the present invention to provide for the display of articles in an economical package arranged and constructed in such a manner as to require a minimal use of material for package fabrication.

It is yet another object of the present invention to provide a display package having integral provisions for supporting the package structure in a substantially vertical orientation relative to a support surface.

It is another object of the present invention to provide a display package in which at least one article to be displayed imparts support to a portion of the display package to maintain the same in a substantially vertical orientation relative to a support surface.

It is yet another object of the present invention to provide a display package for rigidly supporting a plurality of articles, yet which enables easy removal of the articles from the display package by the consumer.

In accordance with the above objects and additional objects which will become apparent hereinafter, the present invention provides a display package principally comprised of a back wall and a base assembly. The back wall includes a top end, a bottom end, a front surface and a rear surface, and further includes a first display means for displaying and holding a first article in place with respect to the back wall. In the illustrative embodiment, the first display means comprises an aperture defined in the front surface of the back wall for receiving at least a portion of the first article as shown.

The display package further includes a base connected to the back wall proximal to the bottom end of the back wall. The base is generally comprised of a top panel, a bottom panel, and includes a second display means for displaying and holding a second article in place with respect to the base. In the depicted embodiment, the second display means comprises an aperture defined in the top panel of the base for receiving at least a portion of the second article such that the first article and the second article are displayed together in complimentary fashion. By "complimentary fashion," it is to be understood that the "first" and "second" articles may be related to each other (as shown in the drawings, e.g., a lid and a cannister) or can be unrelated to each other.

The display package further includes a support for supporting the back wall in a substantially vertical orientation relative to the base. The support comprises a tongue integral with the back wall and movable relative thereto, so that it can be adjusted to fit into the second article displayed in the base to support the back wall and to hold the second article in place.

The respective first and second articles are retained in the display package by retaining lips, flanges or tabs integral with the articles to prevent their inadvertent or accidental removal from the display package. For removal from the package, a sufficient pulling force must be applied to the articles to pull the retaining lips through the apertures.

The display package can be fabricated from a single piece of cardboard, plastic or the like, by folding or molding the same, respectively, along a plurality of predetermined fold lines. The arrangement of the panels can be selected to provide the desired configuration, and will become more apparent as the detailed description of the invention proceeds below with specific reference to the accompanying drawings.

DETAILED DESCRIPTION OF THE PREFERRED EMBODIMENTS

Figure 1:
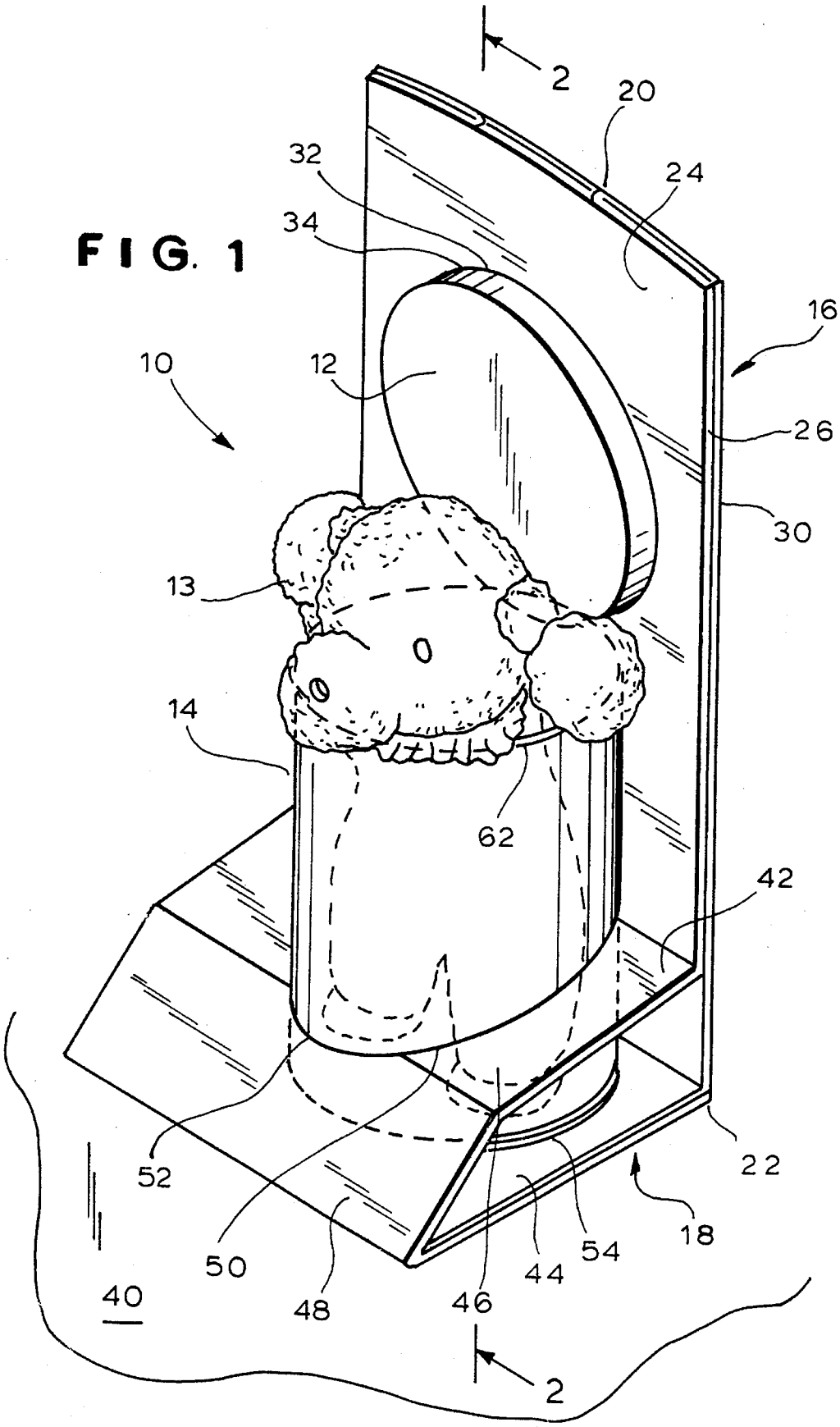
FIG. 1 is an isometric view of a display package in accordance with an illustrative embodiment of the present invention from the top, front and one side thereof.

With reference to the several views of the drawings, there are depicted, in exemplary embodiments, a display package 10 for displaying a first article 12 and a second article 14 together in a complimentary fashion. In the embodiment shown and described, the first article 12 is a cannister lid for the second article 14, a cannister. The cannister 14 holds a stuffed toy 13.

Figure 2:
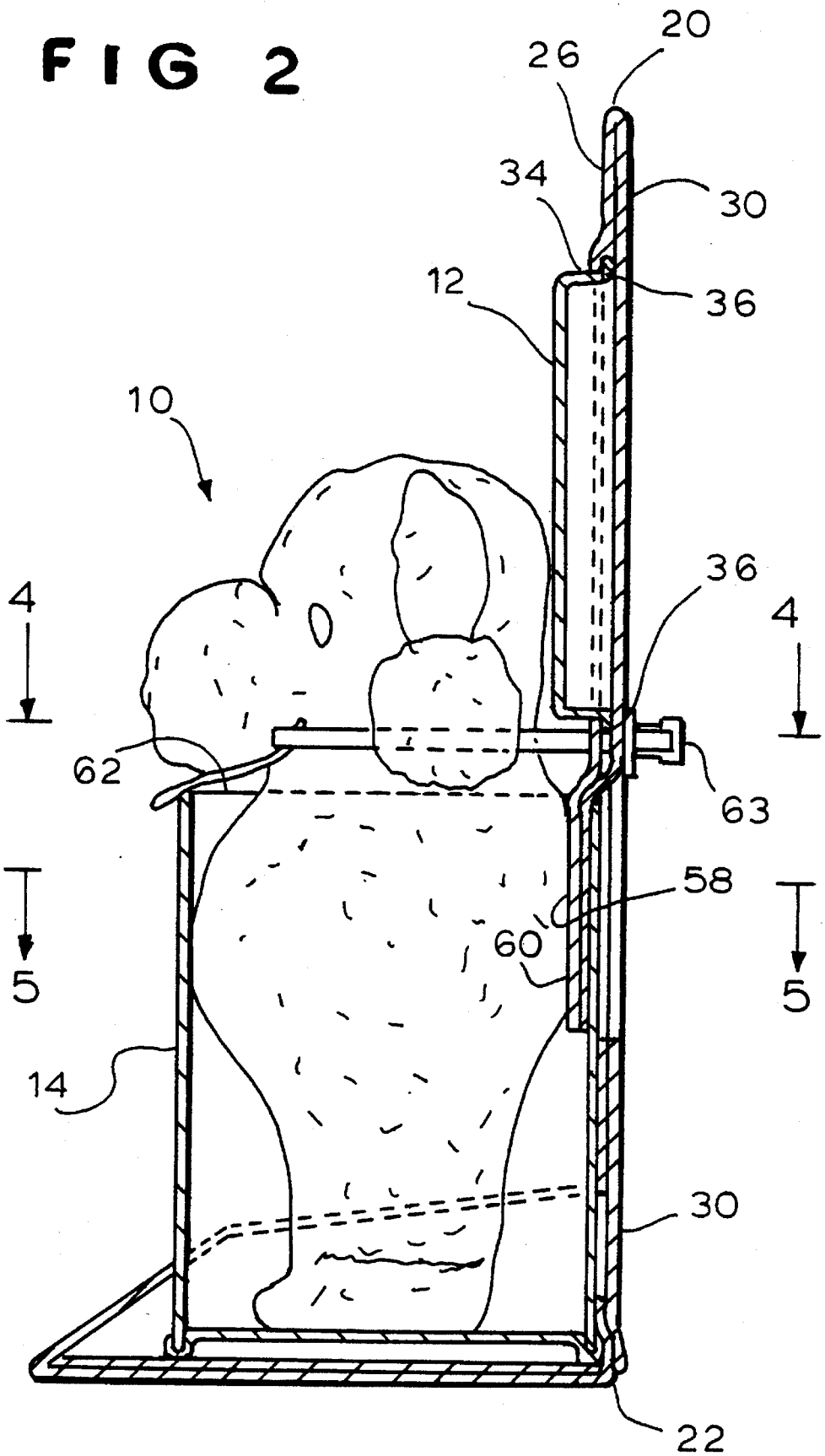
FIG. 2 is a sectional elevational view thereof along lines 2—2 in FIG. 1.
Figure 3:
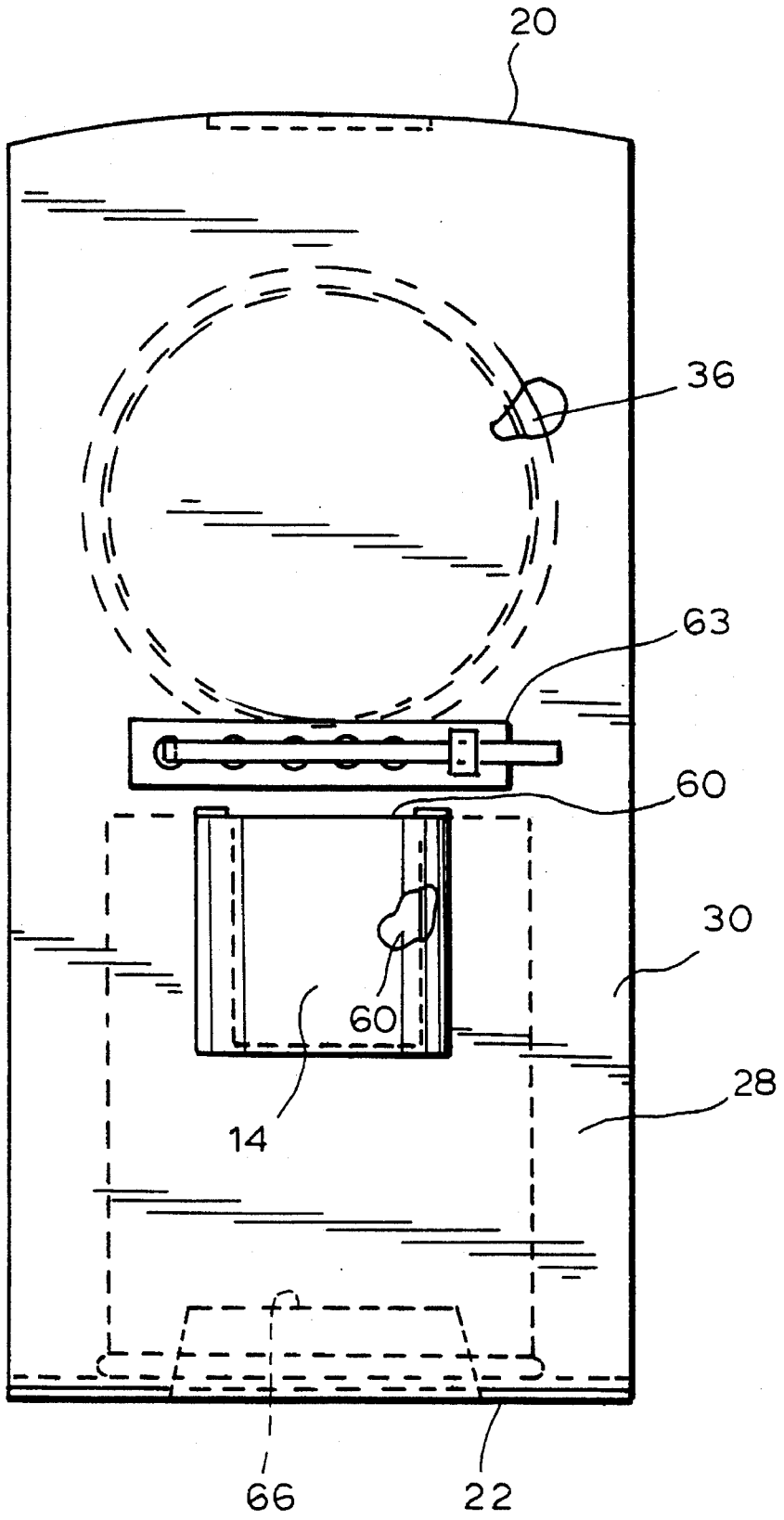
FIG. 3 is a rear elevational view thereof.

Referring now to FIGS. 1–3, the display package 10 is principally comprised of a back wall 16 and a base assembly 18. Although the preferred package construction utilizes cardboard or like materials, it is anticipated that other materials such as plastic could be utilized. The back wall 16 has a top end 20, a bottom end 22, a front surface 24 defined by a first panel 26, a rear surface 28 defined by a second panel 30. The back wall 16 further includes a first display means 32 for displaying the first article 12 and holding the first article 12 in place with respect to the back wall 16. In the embodiment shown, the back wall 16 is comprised of two panels 26, 30 of corrugated cardboard, however, the back wall 16 could also be made using a single panel of cardboard.

In the illustrative embodiment, the first display means 32 consists of an aperture 34 defined in the first panel 26 and disposed near the top end 20 thereof for receiving and holding at least a portion of the cannister lid 12. In this case, the aperture 34 has the same general shape (circular) as the lid, but the shape of the aperture can be selected to receive the particular article to be displayed, and is not limited to a circular configuration as shown and described. In the illustrative embodiment of FIGS. 1–5, the cannister lid 12 cannot inadvertently pass completely through the first panel 26 because of a retaining lip 36 formed on the cannister lid 12 which has a larger in diameter than that of the aperture 34. The cannister lid 12 is thereby captured between the first panel 26 and the second panel 30.

In an alternative embodiment, the cannister lid 12 may have a retaining tab (not shown) which bears against the inside surface 38 of the first panel 26 to prevent the cannister lid 14 from unassisted removal from the back wall 16. Alternatively, the aperture 34 may be slightly undersized relative to the cannister lid 14, thereby causing a press or interference fit between the cannister lid 14 and the aperture 34 to hold the cannister lid 14 in place relative to the back wall 16. In yet another embodiment, the aperture 34 may extend through both the first panel 26 and the second panel 30, with the cannister lid likewise extending therethrough and being retained by one of the methods described above as shown in FIG. 8 and described below.

In the preferred embodiment, the base 18 is constructed and arranged to enable the package structure to be self-supporting in a substantially upstanding orientation relative to a support surface 40. The base 18 includes a top panel 42, and intermediate panel 44 and a bottom panel 46. The top panel 42 is folded around the intermediate panel 44 in such a manner as to provide a transitional panel 48 useful for displaying text or additional information associated with the first and second articles 12, 14, respectively. As shown in FIG. 1, the base 18 further includes a second display means 50 for displaying a second article (cannister) 14 and holding the same in place. The second display means 50 is comprised of an aperture 52 defined in the base top panel 42 for receiving the second article 14.

In the depicted embodiment, the cannister 14 includes a retaining lip 54 that is formed on or attached to the base thereof, having a diameter larger than that of the aperture 52. Alternatively, an interference fit between the aperture 52 and the second article 14 may be provided by appropriately under sizing the aperture 52 relative to the size of the cannister 14 to keep secure the cannister 14 from inadvertently coming loose from the base 18. In addition, the top panel 42 is disposed at an angle relative to the intermediate panel 44 and bottom panel 46, and this orientation helps to hold the cannister 14 in place.

Figure 4:
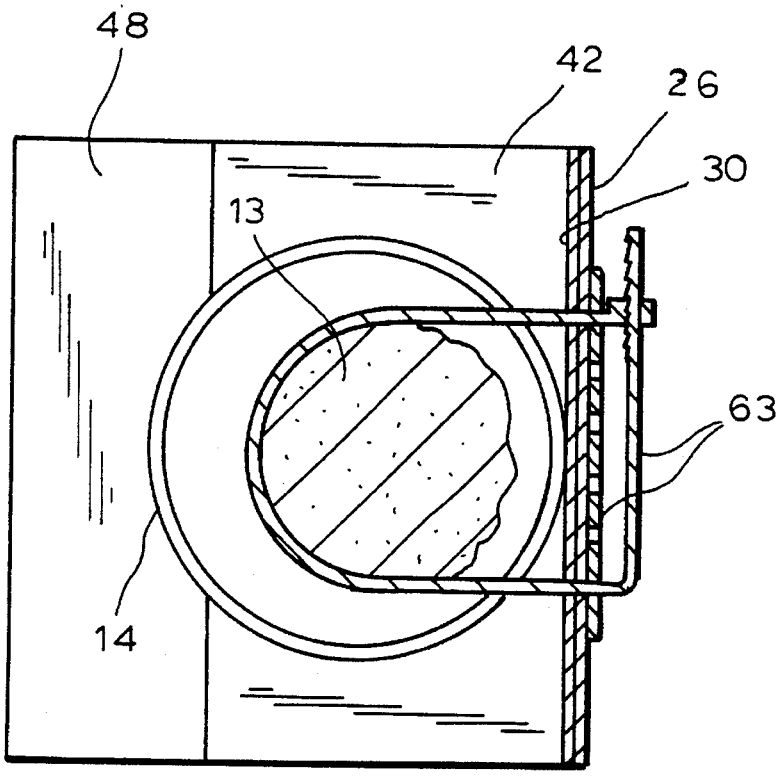
FIG. 4 is a sectional view along lines 4—4 in FIG. 2.
Figure 5:
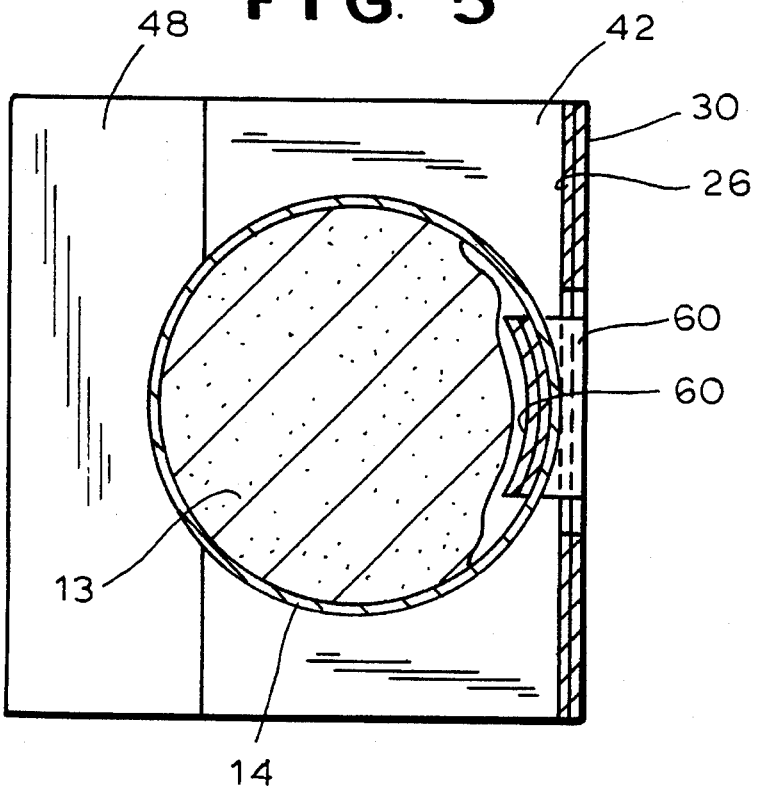
FIG. 5 is a sectional view along lines 5—5 in FIG. 2.

In the preferred embodiment, the support means are identified by the reference numeral 58 and comprises a flexible tongue 60 integral with the first panel 26 and second panel 30. As shown in FIGS. 3 and 5, the tongue 60 is adapted to fit over the upper rim 62 of the cannister and access to the tongue may be obtained through the fenestration 63 defined in the back wall 16. Although the tongue 60 is shown as comprised of part of both panels 26, 30, it may be integral with only one of the panels. The base 64 of the tongue 60 is located proximate to the elevation of the upper rim 62 of the cannister 14. When the tongue 60 is inserted into the cannister 14, it helps to hold the cannister 14 in place relative to the display package 10. In addition, this arrangement structurally associates the back wall 16 with the cannister 14 to help support and maintain the back wall 16 in a substantially vertical orientation relative to the support surface 40. The stuffed toy 13 is anchored by a clasp 63 which fits through apertures 65 in the back wall 16 as shown in FIGS. 3 and 4.

Figure 6:
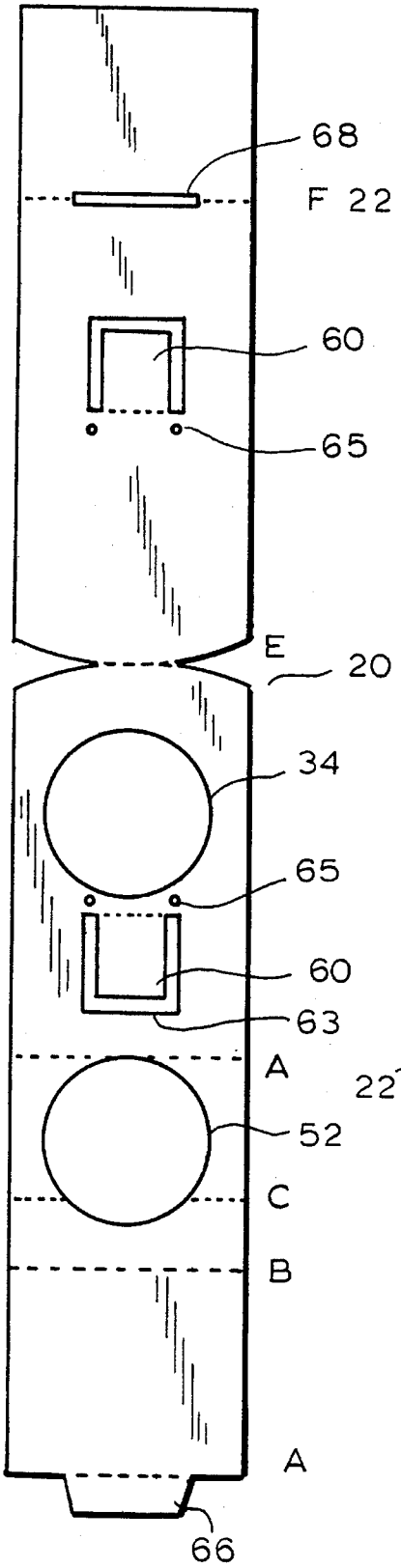
FIG. 6 is a flat pattern of the display package prior to assembly.
Figure 7:
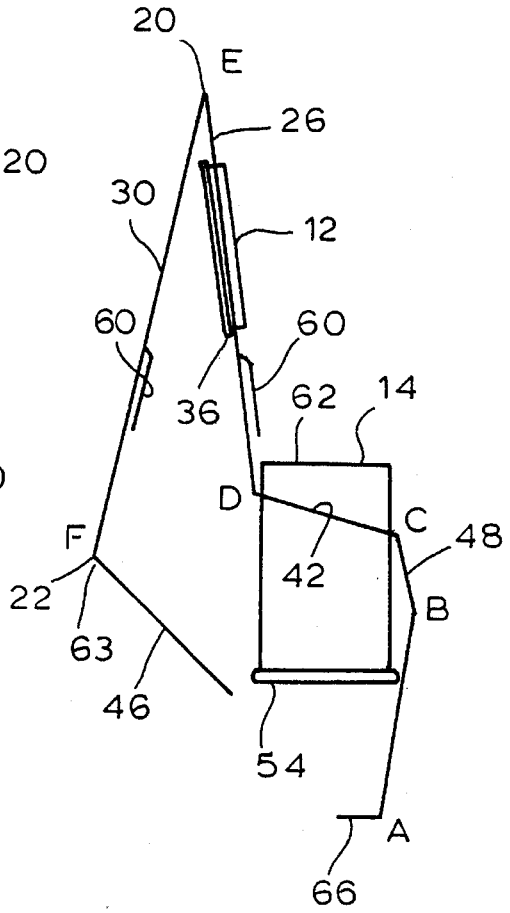
FIG. 7 is a side elevational view of the display package in a partially assembled condition.

Referring now to FIGS. 6 and 7, there is depicted a flat pattern for the assembly and a partial assembly, respectively. The display package 10 may be fabricated from a single, continuous piece of material which is formed along a plurality of predetermined fold lines a–f respectively, segregating the structure into the base intermediate panel 44, back wall second panel 30, back wall first panel 26, base top panel 42, base transitional panel 48, and base bottom panel 46. The material includes pre-cut features as shown and described in the foregoing. In the exemplary embodiment, the display package is assembled with a locking tab 66 which extends from the base bottom panel 46 and is inserted into a slot 68 in the base intermediate panel 44 located proximal to the back wall 16 at fold line f. Alternatively an adhesive may be used in conjunction with or as a substitute for the locking tab 66.

Figure 8:
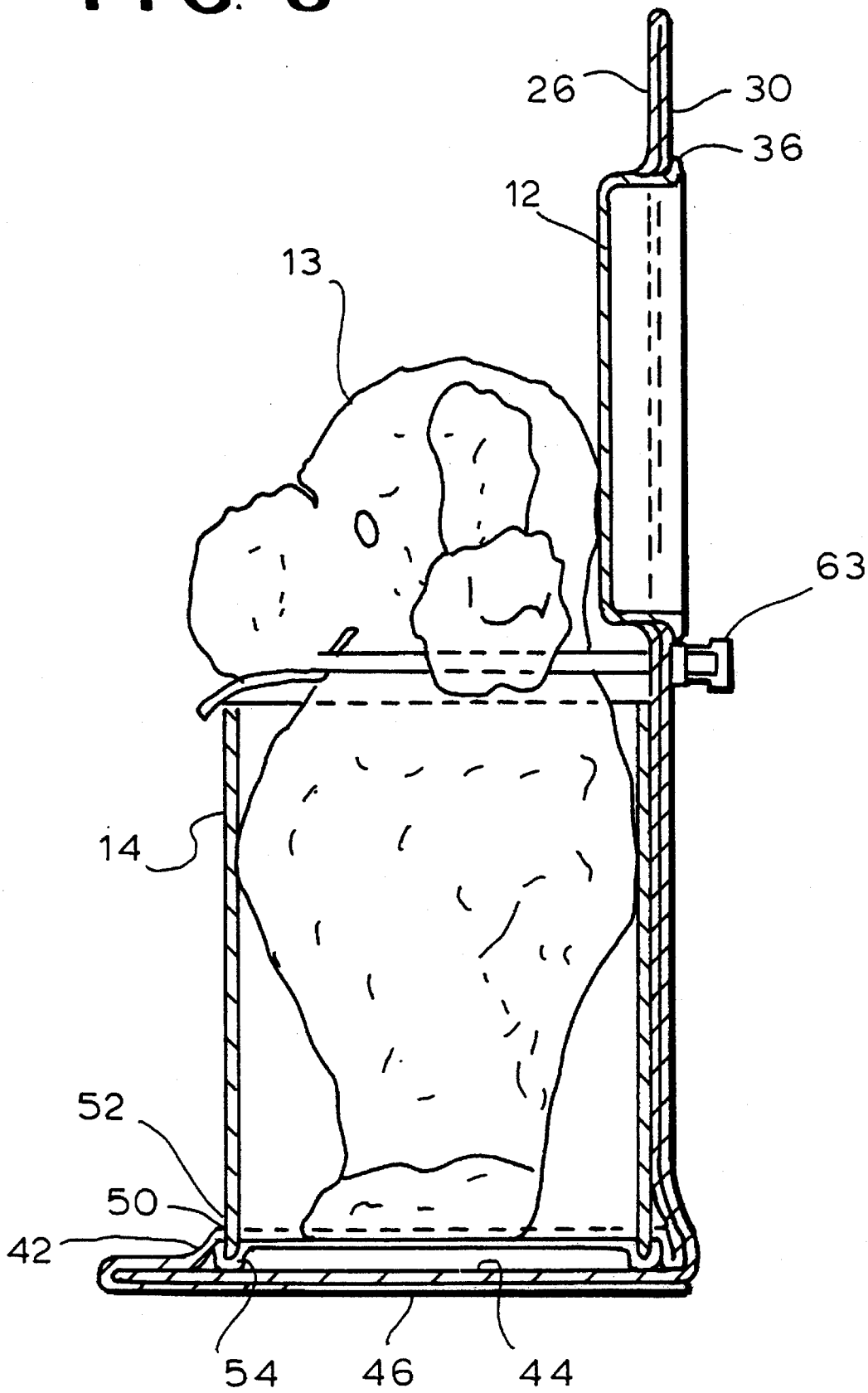
FIG. 8 is a sectional elevational view of a display package similar to that of FIG. 2, but in an alternative embodiment.

FIG. 8 is an alternative embodiment in which the base 18 is formed by the top panel 42, support panel 44, and the bottom panel 46, which are folded and assembled in a flat configuration stacked so as to minimize the height of the base assembly. In this arrangement, the second display means 50 may comprise an aperture 52 defined through one or more of the panels 42, 44, 46, respectively. In addition, the first display means 32 extends through both panels 26, 30 and the rim of the lid is visible from the back as shown.

The present invention has been shown and described in what are considered to be the most practical and preferred embodiments. It is anticipated, however, that departures may be made therefrom and that obvious modifications will be implemented by persons skilled in the art.

I claim:

1. A display package, comprising a first article to be displayed;

a second article to be displayed;

a back wall having a top end, a bottom end, a front surface defined by a first panel, a rear surface defined by a second panel, a first display means for displaying said first article and holding said first article in place relative to said display package, said first display means comprising an aperture defined in said first panel for receiving at least a portion of said first article and holding said first article in place by positioning at least a portion of said first article between said first panel and said second panel;

a base connected to said back wall, said base comprising a top panel, a bottom panel, and a second display means for displaying said second article and holding said second article in place relative to said display package, said second display means comprising an aperture defined in said base top panel for receiving at least a portion of said second article, such that said first article and said second article are displayed together in a complimentary fashion; and support means for supporting said back wall in a substantially perpendicular orientation relative to said bottom panel of said base, said support means adapted for engaging a portion of said second article.

2. The display package as recited in claim 1, wherein said aperture defined through said first panel is disposed proximate to said back wall top end, and said first article is retained by an interference fit between said first article and said first panel.

3. The display package as recited in claim 1, wherein said first article includes a retaining lip which fits between said first panel and said second panel to retain said first article with respect to said back wall.

4. The display package as recited in claim 1, wherein said second article is retained by an interference fit between said second article and said base top panel.

5. The display package as recited in claim 1, wherein said second article has a retaining lip which fits between said base top panel and said base bottom panel to retain said second article with respect to said base.

6. The display package as recited in claim 1, wherein said display package is fabricated from a piece of material folded along a plurality of predetermined fold lines defining said base bottom panel, said back wall second panel, said back wall first panel, and said base top panel.

7. The display package recited in claim 1, wherein said support means comprises a tongue associated with said back wall, said tongue being movable relative to said back wall.

8. A display package, comprising:

a first article to be displayed, said first article including a retaining lip;

a second article to be displayed, said second article including an opening defined at one end thereof;

a back wall having a top end, a bottom end, a front surface defined by a first panel, a rear surface defined by a second panel, and a first display means for displaying said first article and holding said first article in place relative to said back wall, said first display means comprising an aperture defined in said first panel for receiving said first article, wherein said first article includes a retaining lip which fits between said first panel and said second panel;

a base having a top panel, a bottom panel, a support panel and a second display means for displaying said second article and holding said second article in place relative to said base, said base top panel defining an aperture therethrough for receiving said second article, said second article having a retaining lip which fits between said base top panel and said base bottom panel;

support means for supporting said back wall in a substantially perpendicular orientation relative to said bottom panel of said base and holding said second article, said support means including a tongue associated with said back wall for engaging a portion of said second article through said opening defined in said second article.

* * * * *